US006255933B1

(12) United States Patent
Iwao

(10) Patent No.: US 6,255,933 B1
(45) Date of Patent: Jul. 3, 2001

(54) INDUCTANCE DEVICE AND MANUFACTURING METHOD THEREOF

(75) Inventor: Hidemi Iwao, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 09/076,911

(22) Filed: May 13, 1998

(30) Foreign Application Priority Data

May 14, 1997 (JP) ..... 9-123647

(51) Int. Cl.[7] ..... H01F 5/00

(52) U.S. Cl. ..... 336/200; 336/83; 336/223; 336/232

(58) Field of Search ..... 336/200, 232, 336/233, 83

(56) References Cited

FOREIGN PATENT DOCUMENTS 4-130409 5/1991 (JP) .

*Primary Examiner*—Anh Mai
(74) *Attorney, Agent, or Firm*—Lowe Hauptman; Gilman & Berner, LLP

(57) ABSTRACT

When forming an inductance device comprising internal conductors (21*a*–21*f*) which forms a coil and a close looped internal conductor (21*g*) which surrounds the central shaft of the coil, a fixed frequency in a frequency band in which an inductive reactance occurs is set to a targeted frequency f, and values of a series resistance ingredient r and inductance L of the close looped internal conductor (21*g*) are set to a value in a range which is prescribed in ($2\pi f/3.15 \leqq r/L \leqq 2\pi f/0.32$). Accordingly, the effect of the close looped conductive member (21*g*) is obtained at an intended frequency, and a inductance device having a close looped conductive member (21*g*) unlimited its shape and size can be obtained.

9 Claims, 8 Drawing Sheets

*Fig.* 1
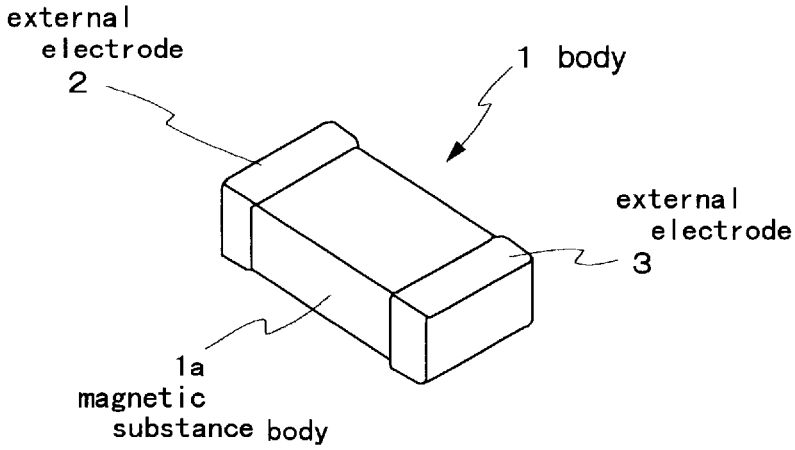
*Fig.* 2
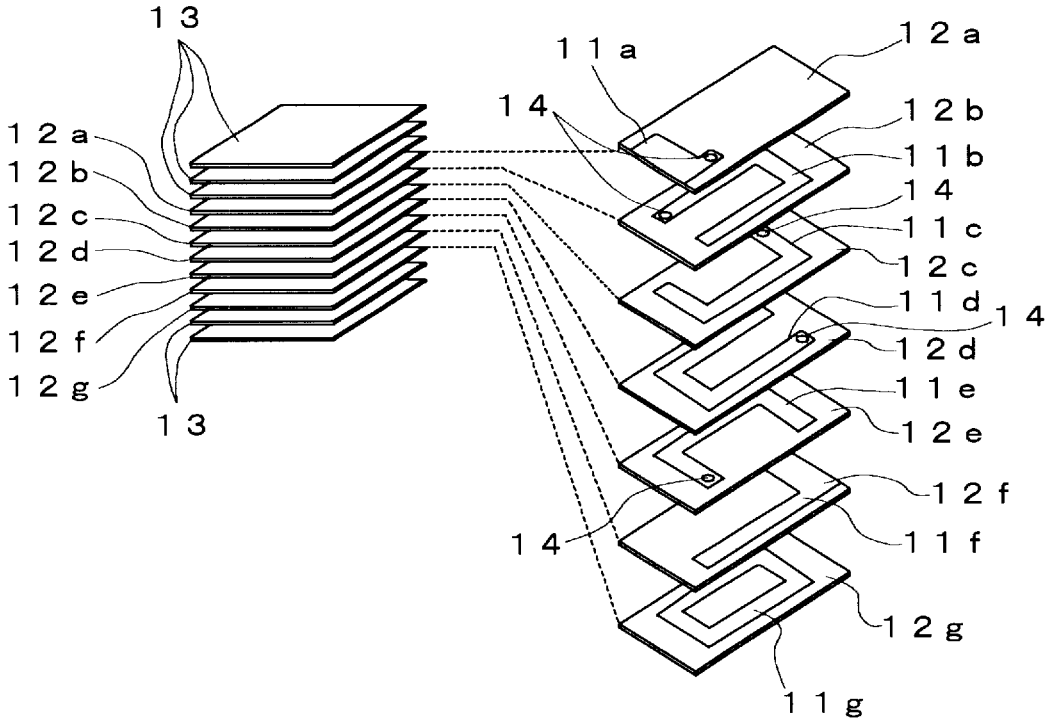

*Fig.* 3
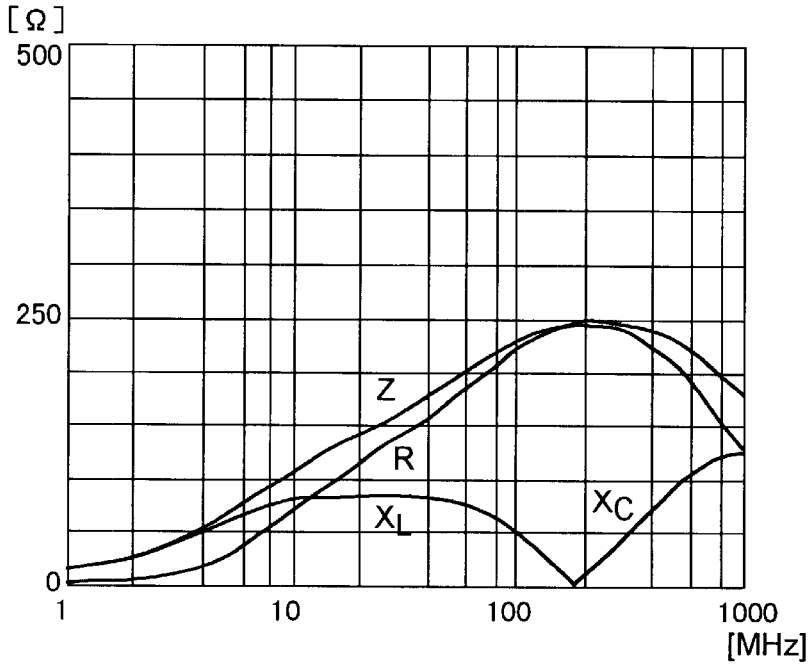
*Fig.* 4
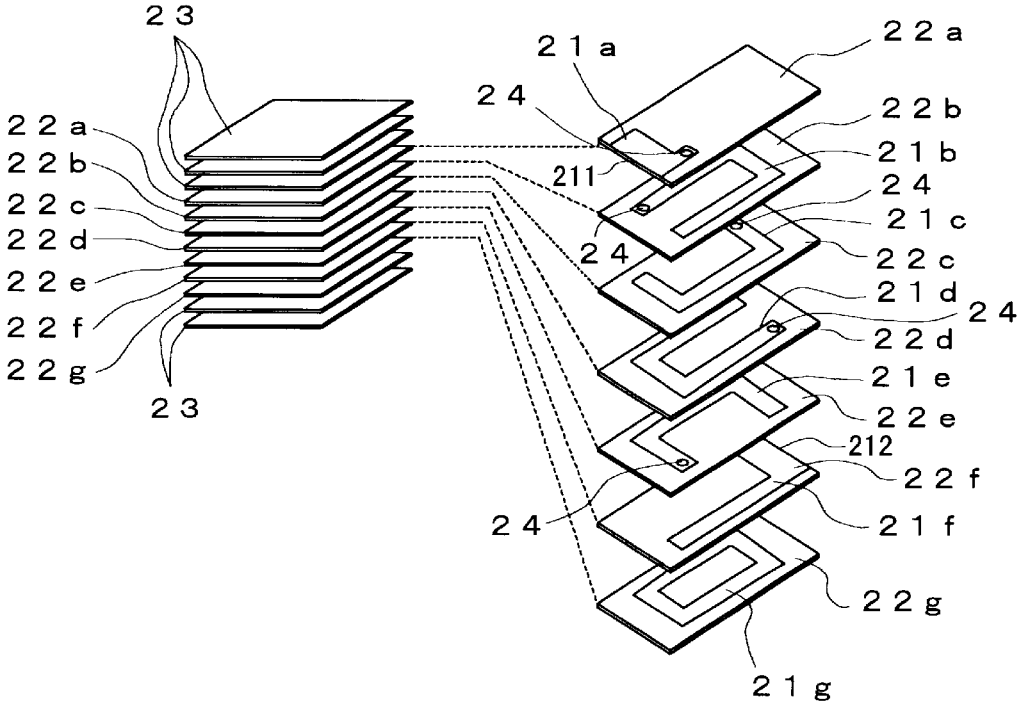

*Fig.* 5

| sample No. | electrical characteristic of closed loop | | |
|---|---|---|---|
| | resistance ingredient r [Ω] | inductance ingredient L [μH] | r／L [$10^6$Ω／H] |
| 1 | 1．2 | 1．00 | 1．2 |
| 2 | 8．0 | 3．90 | 2．1 |
| 3 | 0．9 | 0．30 | 3．0 |
| 4 | 7．5 | 0．30 | 25．0 |
| 5 | 11．0 | 0．15 | 73．3 |
| 6 | 19．5 | 0．10 | 195．0 |
| 7 | no closed loop | | |

*Fig.* 6

| sample No. | Frequency fe | impedance/frequency characteristic | decision |
|---|---|---|---|
| 1 | 12.2MHz | Fig. 7 | × |
| 2 | 12.2MHz | ——— | × |
| 3 | 12.2MHz | ——— | × |
| 4 | 11.2MHz | ——— | △ |
| 5 | 10.7MHz | Fig. 8 | ○ |
| 6 | 11.1MHz | ——— | △ |
| 7 | 12.2MHz | Fig. 3 | ——— |

*Fig.* 9
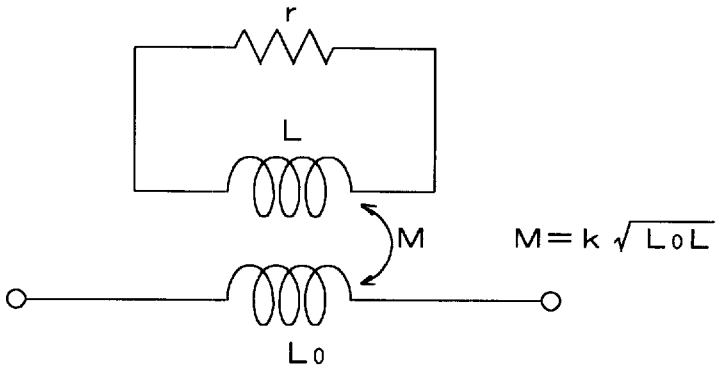
*Fig.* 10
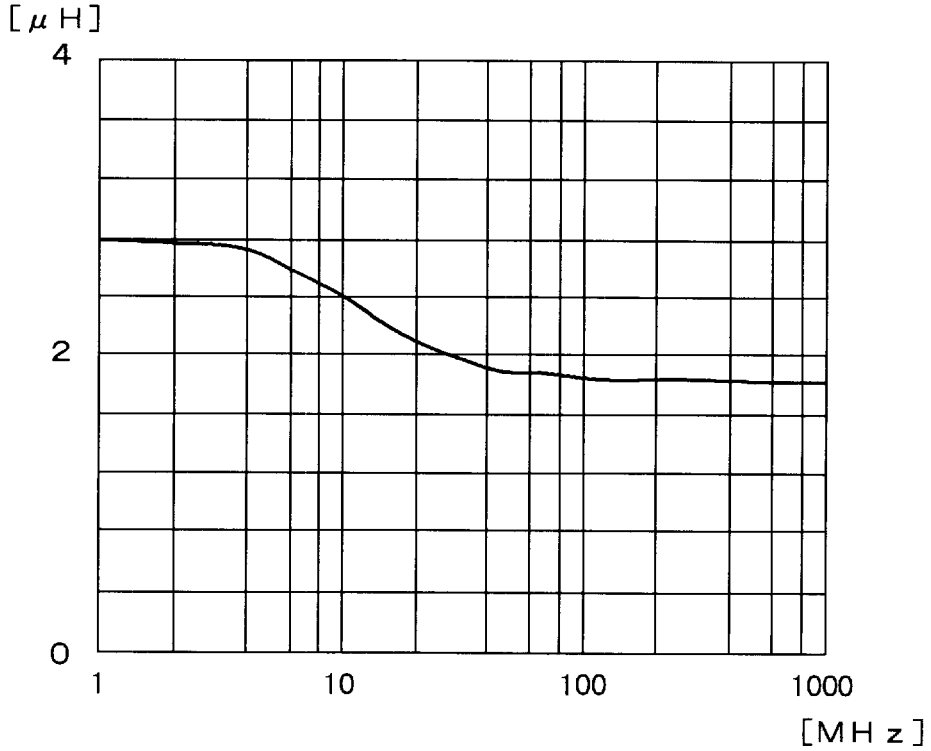

*Fig.* 11
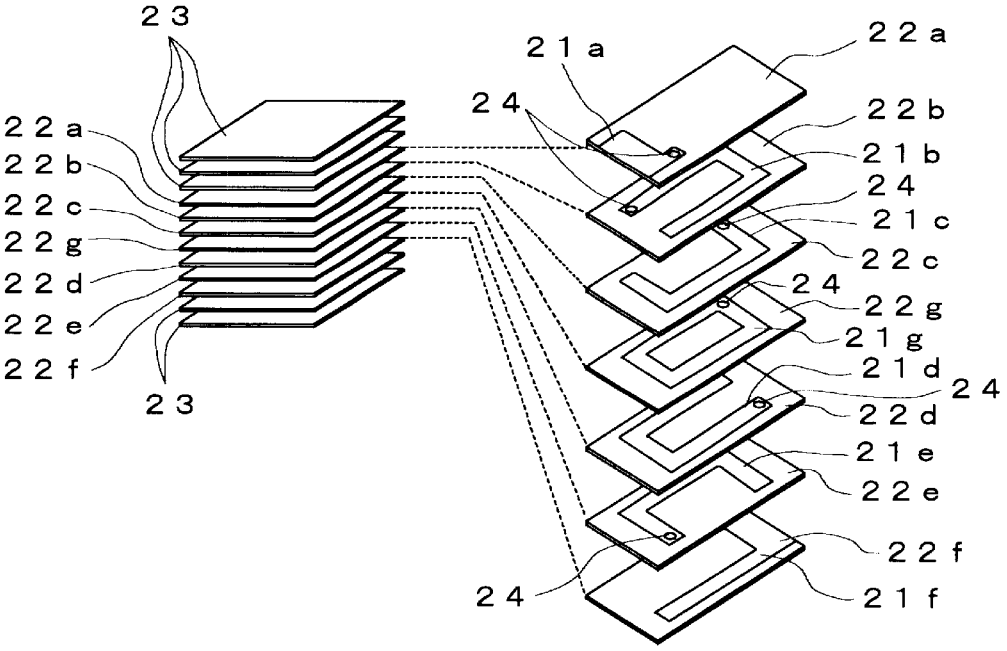
*Fig.* 12
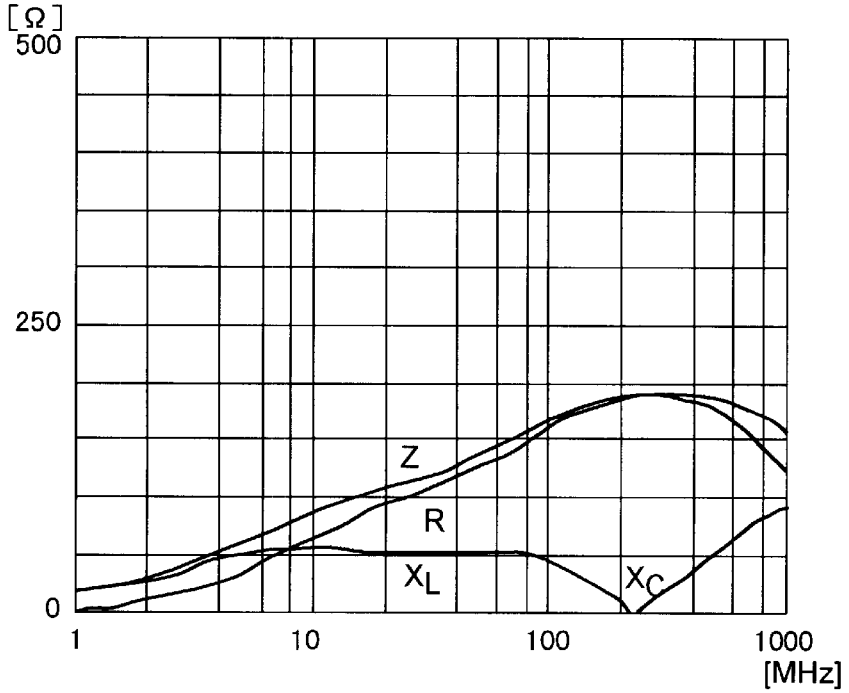

*Fig.* 13
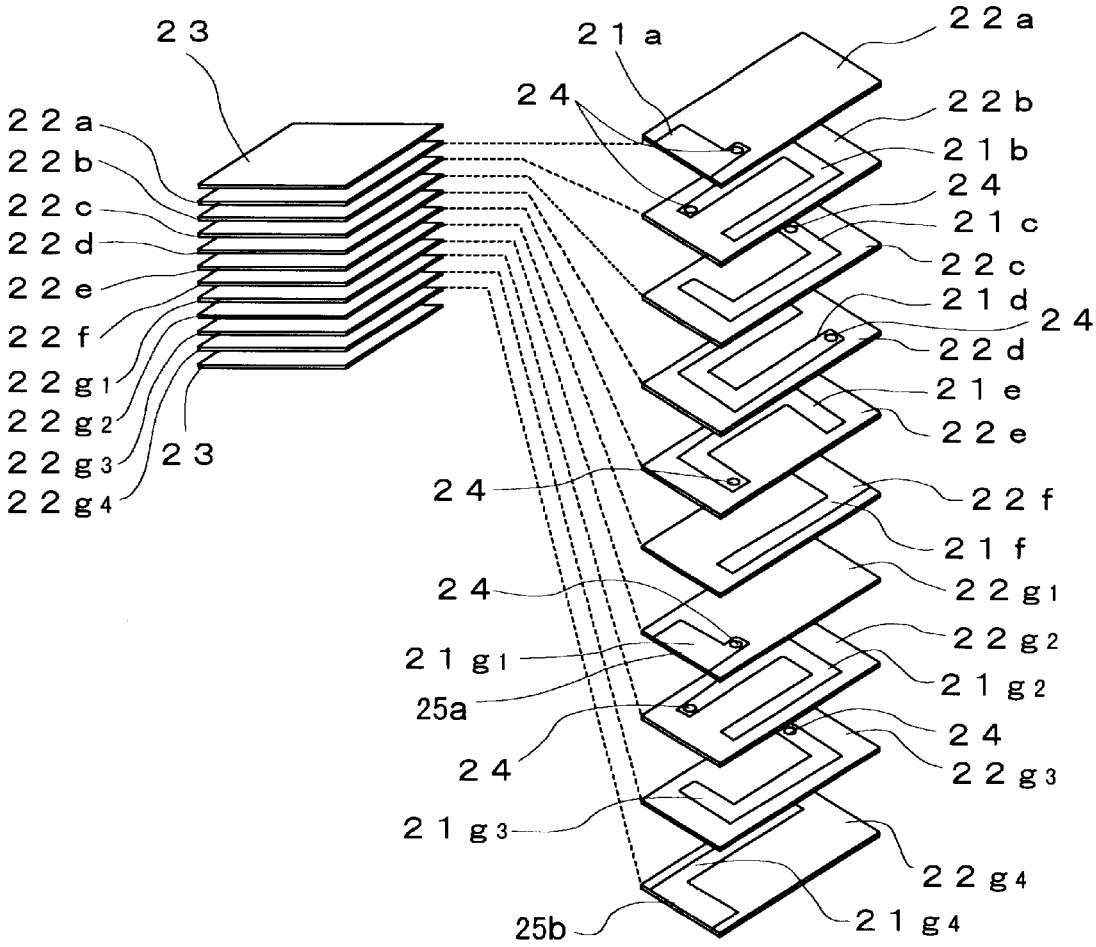

INDUCTANCE DEVICE AND MANUFACTURING METHOD THEREOF

BACKGROUND OF THE INVENTION

1. Field of the Invention

The present invention generally relates to inductance device more particularly, to an inductance device in which an inductive reactance component is surely attenuated at an intended desirable frequency.

2. Description of the Related Art

To prevent electromagnetic interference (EMI) in electronic equipment, an inductance device is usually incorporated into an electric signal line. The impedance of the inductance device includes a resistance component for attenuating noise and a reactance component for reflecting noise.

To reduce EMI, it is desirable to use an inductance device having a large resistance component and a small reactance component in a frequency band for noise removal.

Such an inductance device is disclosed in Japanese Utility Model Laid-open Pub. No. 4-130409.

The configuration of the inductance device disclosed in Japanese Utility Model Laid-open Pub. No. 4-130409 is shown in FIGS. 1 and 2. FIG. 1 is an outward appearance view. FIG. 2 is an exploded view.

In FIG. 1, the body (1) of the inductance device includes a magnetic body (1*a*) having a rectangular parallelepiped shape and conductive members provided inside the magnetic body (1*a*). The conductive members are connected to external electrodes (2, 3) formed at both longitudinal edges of the magnetic substance body (1*a*).

The conductive members provided inside the magnetic substance body (1*a*) are formed as shown in FIG. 2.

That is, the inductance device body (1) is formed by stacking magnetic material sheets (12*a*–12*f*) including internal conductors (11*a*–11*f*) and a magnetic material sheet (12*g*) including a closed loop internal conductor (11*g*). The internal conductors (11*a*–11*f*) are connected to each other in the form of a spiral by a through hole (14) to form a coil.

Moreover, the external electrodes (2, 3) are connected to both edges of the coil composed of internal conductors (11*a*–11*f*).

The above-described inductance device is thus composed of the coil formed by internal conductors (11*a*–11*f*) in the form of a spiral, the internal conductor (11*g*) that is located near the coil and is insulated from the coil and forms a closed loop to surround the central axis of the coil, the magnetic body (1*a*) which is formed by the magnetic material filling a fixed space including the internal conductor (11*a*–11*g*), and a pair of the external electrodes (2, 3) connected to the both edges of the coil and formed outside the magnetic body (1*a*).

According to the inductance device disclosed in said Utility Model Laid-open Pub. No. 4-130409, magnetic flux occurring in the coil induces an electric current to flow through the closed loop internal conductor (11*g*) which is insulated from the remainder of the coil magnetic flux occurring in the coil.

As a result, the resistance component of the inductance device increases, because this electric current is converted to heat by the resistance component of the conductive member which forms internal conductor (11*g*).

Moreover, the reactance component of the inductance device decreases because a reverse magnetic field occurs in response to the electric current which flows through the closed loop internal conductor (11*g*).

By these operations, noise can be removed and the occurrence of EMI can be prevented, because it is possible to set the value of resistance component R larger than the value of the reactance component (inductive reactance $X_L$, capacitive reactance $X_c$ of the inductance device in a frequency band where it is easy for the noise to occur, e.g., the frequency band from 10.08 MHz to 1000 MHZ as shown in FIG. 3.

To make the resistance component R larger than the reactance component ($X_l$, $X_c$) of the inductance device, the internal conductor (11*g*) must be formed for the effect of the above-mentioned closed loop (that is the internal conductor (11*g*)) to occur at a frequency that maximizes the reactance. The frequency must be in a frequency band where the absolute values of both components are equal.

However, a method of obtaining an EMI reduction effect at a specific frequency has not been known in the prior art.

Therefore, the prior art needs considerable time to design the inductance device having the above-mentioned EMI prevention effect, because it is necessary to repeat experimental productions by cut and try methods to get a characteristic for the purpose.

Moreover, when the closed loop (the internal conductor (11*g*)) is placed in the center of the coil, where the coil magnetic field is the strongest, in order to obtain more improved closed loop effect, there is a problem that the shape and size of the closed loop are limited by the coil and then the degree of freedom in design decreases in the prior art since the closed loop is insulated from the coil.

SUMMARY OF THE INVENTION

It is therefore an object of the present invention to provide a new and improved inductance device for bringing about an effect of a closed loop conductive member at an intended frequency.

Another object of the invention is to provide a new and improved inductance device in which the shape and size of a closed loop conductive member are not limited by a coil.

A further object of the invention is to provide a new and improved method of manufacturing such an inductance device.

The inductance device of the present invention comprises a coil which is formed by predetermined conductive members in the form of a spiral, a conductive member which is placed near the coil and in the form of a closed loop surrounding the central axis of the coil, and a pair of connection electrodes connected to both edges of the coil.

Moreover, in the inductance device of the present invention, values of a series resistance component r and inductance L of the closed loop conductive member are set in a range which is defined by the following expression (a), when a predetermined frequency in a frequency band wherein the inductive reactance occurs is set to a targeted frequency f.

$$2\pi f/3.15 \leqq r/L \leqq 2\pi f/0.32 \quad \text{(a)}$$

The inductance device of the present invention enables a closed loop conductive member surrounding the central axis of the spiral-shaped coil to be placed in the predetermined location adjacent the coil.

Moreover, the values for a series resistance component r and an inductance L of the closed loop conductive member are set in the range prescribed by the above-mentioned formula (a), when the predetermined frequency in the frequency band in which the inductive reactance occurs is set to the targeted frequency f.

Accordingly, when current flows through the coil, an electric current based on Lenz's law flows through the closed loop formed by the conductive member, because magnetic flux which occurs in response to the electric current flowing through the coil intersects the closed loop conductive member.

Moreover, another magnetic flux occurs in response to the electric current that flows through the closed loop conductive member. This magnetic flux has a direction to negate the magnetic flux which occurs in the coil.

Moreover, because the resistance component of this conductive member converts energy of the electric current which flows through the closed loop into heat energy, the loss resistance of the inductance device increases. Moreover, in the predetermined frequency band centered on the above mentioned targeted frequency, the inductive reactance of the inductance device falls.

Therefore, the said inductance device can set the resistance ingredient larger than the inductive reactance ingredient thereof in the specific frequency area centered on the targeted frequency in which the noise occurs easily.

Accordingly, the inductance device of the present invention has the effect of the closed loop conductive member conspicuously at the targeted frequency and has the ability in EMI prevention including noise removal.

Moreover, in the inductance device of the present invention, after determining a frequency which maximizes the value of the inductive reactance obtained when the closed loop conductive member component is not present in the coil, the targeted frequency is set to the acquired frequency.

Thus, if the targeted frequency is set to the frequency which maximizes the value of the inductive reactance component when the closed loop conductive member is not present in the coil, the maximum value of the inductive reactance component can be decreased.

Therefore, the inductance device having the resistance component which is larger than an inductive reactance component can be obtained, thereby improving the noise removal effect.

Also, according to the inductance device of the present invention, after determining a frequency which causes the value of the resistance component to equal the value of the inductive reactance component obtained when the closed loop conductive member is not present in the coil, the targeted frequency is set to the acquired frequency.

In this way, by setting the targeted frequency to the frequency which causes the value of the resistance component to equal the value of the inductive reactance component obtained when the closed loop conductive member component is not present in the coil, the inductive reactance component can be reduced and a frequency band in which the value of the resistance component is larger than the value of the inductive reactance component can be expanded.

Therefore, an inductance device having noise removal effects in a wide frequency band is provided.

In another embodiment of the inductance device of the present invention, the closed loop conductive member and the conductive member forming the coil are electrically connected.

In this way, even if the closed loop conductive member is electrically connected to the conductive member forming the coil, the above-mentioned operation can be carried out by the closed loop conductive member.

Therefore, the degree of freedom in designing the inductance device is greater as a result of the present invention.

Also, in a further embodiment of the inductance device of the present invention, the closed loop conductive member is in the center of the coil, where the strongest magnetic field in the coil exists.

As a result, the electric current which flows through the closed loop conductive member increases with the magnetic flux occurring in the coil. By increasing the electric current, the loss resistance of the inductance device increases to a greater extent and the inductive reactance component of the inductance device in the predetermined frequency band centered on the targeted frequency decreases more.

Therefore, in the above inductance device, the value of the resistance component becomes larger than that of the inductive reactance component, and the frequency band wherein the resistance component becomes larger than the inductive reactance component is expanded to a greater extent. Thus the noise removal effect is improved more.

Also, according to the present invention, the ratio (r/L) of the series resistance component r to the inductance L is evaluated by using the targeted frequency f and the following equation (b) while manufacturing the inductance device.

$$f=\tfrac{1}{2}\pi(r/L) \tag{b}$$

The closed loop conductive member of the inductance device is formed so that the value of the ratio (r/L) satisfies the following expression (c).

$$2\pi f/3.15 \leq r/L \leq 2\pi f/0.32 \tag{c}$$

In Equation (b), (r) and (L) respectively represent the series resistance component and inductance of the closed loop conductive member. The predetermined frequency in the frequency band wherein the inductive reactance occurs is set to the targeted frequency f.

In the inductance device manufactured by using the above-mentioned manufacturing method, the magnetic flux which occurs in response to the electric current which flows through the coil intersects the closed loop conductive member, and an electric current based on Lenz's law flows through the closed loop in which the conductive member formed. This electric current generates a magnetic field having a direction which negates the magnetic flux which occurs in the coil.

Moreover, since the energy of electric current flowing through the closed loop is converted to heat energy by the resistance component of the closed loop conductive member, the loss resistance of the inductance device increases.

Accordingly, in the predetermined frequency band centered on the targeted frequency, the inductive reactance component of the inductance device falls.

Therefore, an inductance device wherein the inductive reactance component in the predetermined frequency band centered on the specific targeted frequency is decreased can be easily and quickly designed and be manufactured.

Therefore, the present invention easily provides the inductance device which has the effect of the closed loop conductive member conspicuously at the targeted frequency and has the ability of EMI prevention including noise removal.

Moreover, in a method of manufacturing the above-mentioned inductance device of the present invention, the targeted frequency is set to the frequency which maximizes the value of the inductive reactance component when the closed loop conductive member component is not present in the coil.

According to the manufacturing method of the above mentioned inductance device, the maximum value of the inductive reactance component of the completed inductance device can be degraded, because the targeted frequency is set to the frequency which maximizes the value of the inductive reactance component when the closed loop conductive member is not present in the coil.

Therefore, it is possible to make the resistance component much larger than the inductive reactance ingredient of the completed inductance device, thereby causing sure noise removal effect.

Also, in the method of manufacturing the above-described inductance device of the present invention, the above-mentioned targeted frequency f is set to the frequency wherein the value of the resistance component nearly equals that of the inductive reactance component when the closed loop conductive member is not present in the coil.

According to the method of manufacturing the inductance device, the inductive reactance component of the completed inductance device can be lowered, and the frequency band in which the value of the resistance component is larger than the value of the inductive reactance component can be expanded.

Therefore, the complete inductance device has a high noise removal effect in a wide frequency band.

BRIEF DESCRIPTION OF THE DRAWINGS

In order to more fully understand the drawings used in the detailed description of the present invention, a brief description of each drawing is provided.

FIG. 1 is an outward appearance perspective view of an example of an inductance device of the prior art.

FIG. 2 is an exploded view of the inductance device of the prior art.

FIG. 3 is a plot of impedance vs. frequency characteristic of the prior art inductance device.

FIG. 4 is an exploded view of an inductance device of an embodiment of the present invention.

FIG. 5 is a chart of a frequency characteristic of a closed loop conductive member of six experimental samples of the FIG. 4 embodiment of the present invention.

FIG. 6 is a chart of a measurement result of a frequency at which a resistance component and an inductive reactance component of the six experimental samples of FIG. 5 and an inductive device that does not have a closed loop, per sample 7 of FIG. 5.

FIG. 9 is an equivalent circuit diagram of the inductance device of the embodiment of FIG. 4.

FIG. 10 is a plot of an example of a frequency characteristic with formula (1) of the embodiment of the present invention.

FIG. 11 is an exploded view of an inductance device of a third embodiment of the present invention.

FIG. 12 is a plot of a frequency characteristic of the inductance device of the third embodiment of the present invention.

FIG. 13 is an exploded view of an inductance device of a fourth embodiment of the present invention.

DESCRIPTION OF THE PREFERRED EMBODIMENTS

Figure 7:
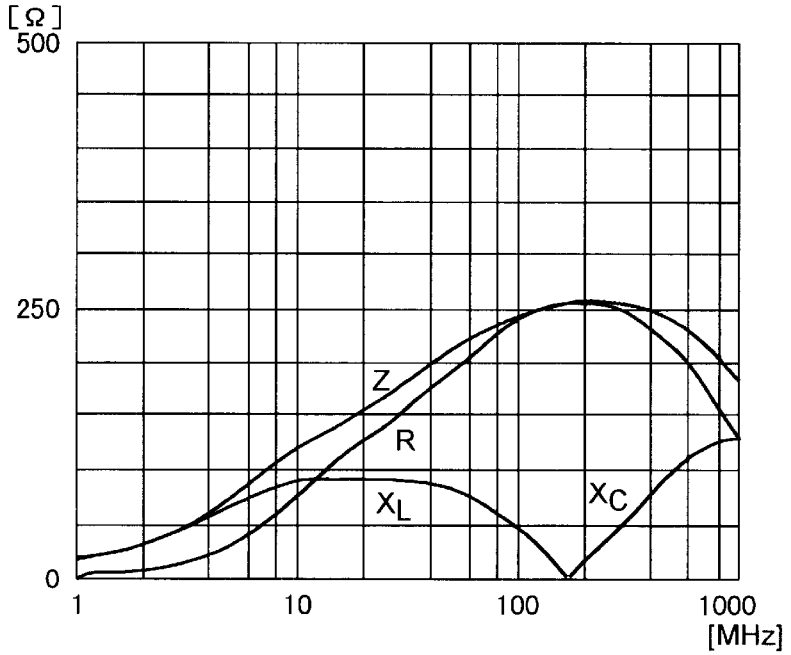
FIG. 7 is a plot of an impedance vs. frequency characteristic of an inductance device of sample No. 1 as illustrated in FIGS. 5 and 6.

The present invention will be described in further detail by way of example with reference to the accompanying drawings.

The outward appearance of an inductance device of an embodiment of the present invention is the same as the prior art inductance device shown in FIG. 1. A body (1) of the inductance device has the shape of a rectangular parallelepiped and includes external electrodes (2,3) at opposite ends in the longitudinal direction of the body (1).

As shown in FIG. 4, the body (1) is integrally formed by stacking plural magnetic material sheets (22*a*–22*g*) having internal conductors (21*a*–21*g*) interleaved with a plurality of magnetic sheets (23) that do not include internal conductors.

The internal conductors (21*a*–21*f*) of the magnetic material sheets (22*a*–22*f*) are made of a metallic conductor mainly containing silver. Each internal conductor (21*a*–21*f*) is electrically connected by through holes (24) to provide a spiral shape. Then, a coil is formed by the electrically connected internal conductors (21*a*–21*f*).

Moreover, both edges of the coil, that is, a first end part (211) of the internal conductor (21*a*) and a second end part (212) of the internal conductor (21*f*), are exposed on end surfaces in the longitudinal direction of the inductance device body (1).

Also, the internal conductor (21*g*) formed in the magnetic material sheet (22*g*) includes a metallic conductor which contains mainly silver similar to the internal conductors (21*a*–21*f*).

Moreover, the internal conductor (21*g*) takes the form of a closed loop which has a predetermined area and surrounds the central axis of the above-mentioned coil and overlaps this coil.

The exposed internal conductor (21*a*) is connected electrically to the external electrode (2) on the first of the inductance device body (1).

The following examples are illustrative of methods of manufacturing the inductance device of the present invention.

First, ceramic green-sheets are formed by a doctor blade process with a high loss ferrite material which consists of $Fe_2O_3$ (50 mol %), ZnO (25 mol %), NiO (10 mol %), CuO (10 mol %), and MnO (5 mol %). After this, the ceramic green-sheets are cut into predetermined rectangles. Then, the through holes (24) are formed on predetermined positions of the ceramic green-sheets.

Next, each internal conductor (21*a*–21*g*) is printed like a matrix onto surfaces of the ceramic green-sheets with conductive material paste mainly containing silver.

After this, the ceramic green-sheets printed with the internal conductors are edited, stacked in fixed order, and then pressured to form an integral multilayered body.

Next, the multilayered body is cut to conform with a shape of the body (1) of the inductance device.

The cut multilayered body is burned for three hours at 900° C. temperature to form a magnetic substance body, i.e., the inductance device body (1).

Moreover, by coating the conductive material paste on both end parts of the inductance device body (1) and baking it at 700° C. temperature, the external electrodes (2, 3) are formed.

Accordingly the inductance device of the rectangular parallelepiped shape is completed.

In this way, seven different inductance devices (sample Nos. 1–7,) were experimentally made. Sample Nos. 1–6 have the closed loop internal conductor (21*g*) having the a frequency characteristic shown in FIG. 5. Sample No. 7 differs from sample Nos. 1–6 because sample No. 7 does not include closed loop internal conductor (21*g*). Consequently, sample No. 7 does not have the frequency characteristics shown by the closed loop internal conductor (21*g*). The electrical characteristics of the spiral coil formed by the internal conductors (21*a*–21*f*) of each of sample Nos. 1–7 are the same.

FIG. 5 is a chart of the electrical characteristics only of the closed loop internal conductor (21*g*) in which a series resistance component r and an inductance component L differ.

Values of the series resistance component r and the inductance component L of the closed loop internal conductor (21*g*) shown in FIG. 5 can be measured as follows.

An open loop is produced by forming a slit in a part of the closed loop internal conductor (21*g*). And then, the value s are measured by using both edges of the open loop as terminals.

Also, by changing the thickness, length, conductor material, core area, and material for the magnetic substance body in the closed loop internal conductor (21*g*), the values of the series resistance component r and inductance component L in the closed loop internal conductor (21*g*) are varied.

The electrical characteristics of the closed loop internal conductor (21*g*) for the sample Nos. 1–6 shown in FIG. 5 are as follows:

Sample No. 1: series resistance component is 1.2Ω, inductance component L is 1.00 μH, and the ratio (r/L) of them is $1.2\times10^6$ Ω/H.

Sample No. 2: series resistance component r is 8.0Ω, inductance component L is 3.90 μH, and the ratio (r/L) of them is $2.1\times10^6$ Ω/H.

Sample No. 3: series resistance component r is 0.9Ω, inductance component L is 0.30 μH, and the ratio (r/L) of them is $3.0\times10^6$ Ω/H.

Sample No. 4: series resistance component r is 7.5Ω, inductance component L is 0.30 μH, and the ratio (r/L) of them is $25.0\times10^6$ Ω/H.

Sample No. 5: series resistance component r is 11.0Ω, inductance component L is 0.30 μH, and the ratio (r/L) of them is $73.3\times10^6$ Ω/H.

Sample No. 6: series resistance component r is 19.5Ω, inductance component L is 0.30 μH, and the ratio (r/L) of them is $195.0\times10^6$ Ω/H.

FIG. 6 shows measurement results of a frequency $f_e$ in which the value of the resistance component R matches that of an inductive reactance component $X_L$ in the inductance device of each of sample Nos. 1–7.

The agreement frequency $f_e$ for each of sample Nos. 1–3 is 12.2 MHz

The agreement frequencies $f_e$ of sample Nos. 4, 5, 6 and 7 are respectively 11.2 MHz, 10.7 MHz, 11.1 MHz, and 12.2 MHz.

These measurement results for sample Nos. 1–6 occur when the coil, which is formed by the internal conductors (21*a*–21*f*), is combined with the closed loop internal conductor (21*g*) and the results for sample No. 7 are for an open loop internal conductor, otherwise the same as conductor (21*g*).

The above-described electrical characteristics of the closed loop internal conductors and frequency $f_e$ shown for sample Nos. 1–7 result in the following facts.

The frequency $f_e$ at which the resistance component R agrees with the inductive reactance component L of the inductance device is influenced by the ratio (r/L) of the series resistance component r to the inductance component L in the closed loop internal conductor (21*g*).

Then, in order to minimize the frequency $f_e$ and to derive the maximum effect of the closed loop internal conductor (21*g*), a specific relation must be formed between the series resistance component r and the inductance component L.

In the examples shown in FIG. 5 and FIG. 6, the device having the smallest frequency $f_e$ wherein the resistance component R agrees with the inductive reactance component L, and the maximum effect of the closed loop internal conductor (21*g*) is sample No. 5 wherein ($r/L=73.3\times10^6$ (Ω/H).

Samples Nos. 4 and 6 wherein ($r/L=25.0\times10^6$ (Ω/H), and $r/L=195.0\times10^6$ (Ω/H) are respectively inferior to sample No. 5; however, they also show the effect of the closed loop internal conductor (21*g*).

Figure 8:
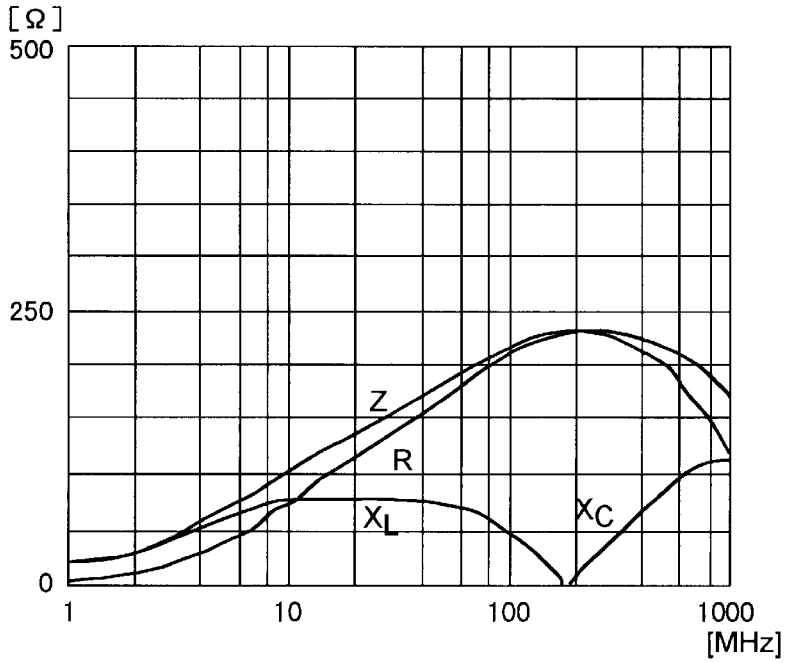
FIG. 8 is a plot of an impedance vs. frequency characteristic of an inductance device of sample No. 5 as illustrated in FIGS. 5 and 6.

FIGS. 7 and 8 respectively indicate the impedance vs. frequency characteristics of sample Nos. 1 and 5.

In these Figs., (R) is a resistance component, ($X_L$) is an inductive reactance component, ($X_c$) is a capacitive reactance component, and (z) is the impedance of the entire coil obtained by combining the R, $X_L$ and $X_c$ components.

The relation between the series resistance component r and the inductance component L of the closed loop internal conductor (21*g*) to bring out the maximum effect of the closed loop internal conductor (21*g*) can be derived as follows. An equivalent circuit of the coil including closed loop internal conductor (21*g*) is shown in FIG. 9.

The inductance ($L_1$) of the equivalent circuit is shown by the following formula (1).

$$L_1=L_0[1-\{(2\pi f)^2k^2/((2\pi f)^2+(r/L)^2)\}] \quad (1)$$

In formula (1), $L_1$ is the inductance of the equivalent circuit, $L_0$ is the inductance of the coil, r is the series resistance component of the closed loop internal conductor (21*g*), L is the inductance of the closed loop internal conductor (21*g*), k is a magnetic coupling coefficient between the closed loop internal conductor (21*g*) and the coil formed by the internal conductors (21*a*–21*f*), and f is the frequency of AC current flowing in the coil represented by the equivalent circuit.

FIG. 10 is a plot of inductance vs. frequency characteristic resulting from Equation (1). In FIG. 10, the frequency wherein the inclination (i.e., slope) characteristic c has the largest value can be obtained as follows.

By differentiating Equation (1) as a function of frequency, the slope of $L_1$ as a function of frequency is given by the following expression (2).

$$-L_0\{2K^2(2\pi f)^2(r/L)^2/((2\pi f)^2+(r/L)^2)^2\} \quad (2)$$

And, under the condition that the variation becomes 0 when the formula (2) is differentiated the frequency where the slope of Equation (1) is maximum is given by the following Equation (3).

$$f=\tfrac{1}{2}\times(r/L) \quad (3)$$

By substituting Equation (3) for f into expression (2), expression (2) yields the maximum slope which is represented by formula (4).

$$-L_0k^2/2 \quad (4)$$

The inductive reactance component $X_L$ of the coil is proportional to the inductance $L_0$ of the coil, i.e., $X_L=2\pi fL_0$.

Therefore, the inductive reactance component $X_L$ is greatly decreased at the frequency that is brought about with Equation (3).

In the inductance device (sample No. 7) which does not have the above mentioned closed loop internal conductor (21*g*), the frequency wherein resistance component R and inductive reactance component $X_L$ agree is 12.2 MHz.

Then, if 12.2 MHz is substituted for the frequency f of Equation (3), the relation between the series resistance component r and the inductance L decreasing the reactance component the most at this frequency is shown by the following Equation (5).

$$r/L=76.6\times10^6(\Omega/\mathrm{H}) \quad (5)$$

The relation shown in Equation (5) between the series resistance component r and the inductance L agrees approximately with the relation between series resistance component r and inductance L in the inductance device of sample No. 5.

Also, if the frequency 12.2 MHz and the electrical characteristic ($r/L=25.0\times10^6$ [Ω/H]) are exhibited in the closed loop internal conductor (21*g*) of sample No. 4 for the expression (2), the slope is shown in the following expression (6).

$$-0.174L_0k^2(=-L_0k^2/2\times34.8) \quad (6)$$

The slope shown by the expression (6) is equivalent to 34.8% of expression (4) having the maximum slope. This inclination is approximately equivalent to ⅓ of the maximum inclination.

Therefore, the conspicuous effect of the closed loop internal conductor (21*g*) can be attained if it has such a slope with this degree.

The frequency characteristic shown in FIG. 10 has two frequencies which make the slope of the characteristic curve ⅓ of maximum.

These two frequencies can be obtained by solving Equation (2) for the slope shown in the following expression (7).

$$(-L_0k^2/2)/3 \quad (7)$$

As a result, two frequencies f indicated by the following expression (8) are obtained as the frequency at which the slope of the characteristic curve becomes ⅓ of maximum.

$$2\pi f=0.32(R/L)\text{or } 3.15(r/L) \quad (8)$$

Accordingly, the conspicuous effect of the closed loop internal conductor (21*g*) can be obtained in the frequency band which is between these two frequencies.

Therefore, if a frequency in the frequency band in which inductive reactance $X_L$ occurs is set as a targeted frequency f, and then the series resistance component r and the inductance L in the closed loop internal conductor (21*g*) are set to the value in the range prescribed with the formula (a) ($[2\pi f/3.15\leqq r/L\leqq 2\pi f/0.32]$), it is possible to produce the inductance device conspicuously having the effect of the closed loop internal conductor (21*g*).

Such an inductance device can be easily manufactured by the following procedure.

First, a frequency band in which the inductive reactance $X_L$ occurs when the inductance device does not have the closed loop internal conductor is measured.

Next, the frequency in this frequency band is set to the targeted frequency f Then, the targeted frequency f is substituted for the Equation (b) ($[f=½\pi(r/L)]$) to determine a ratio (r/L) of the series resistance component r to the inductance L.

In this case, r is the series resistance component of the closed loop internal conductor (21*g*) of the forming object, and L is the inductance of the closed loop internal conductor (21*g*) of the forming object. Then, the procedure is completed by forming the closed loop internal conductor (21*g*) so that the value of the ratio (r/L) satisfies the expression (c) $[2\pi f/3.15\leqq r/L\leqq 2\pi f/0.32]$.

With this method of manufacturing, the inductance device conspicuously exhibiting the effect of the closed loop internal conductor (21*g*) can be easily and quickly designed and manufactured.

The following example describes the primary implementation example of this embodiment.

The inductance device of the primary implementation example has the structure shown in FIGS. 1 and 4.

In the inductance device of the primary implementation example, the closed loop internal conductor (21*g*) is formed by setting the above-mentioned targeted frequency f to the frequency which maximizes the value of the inductive reactance component $X_L$ when the closed loop internal conductor (21*g*) is not present in the coil.

In this inductance device, the maximum of the inductive reactance component $X_L$ is reduced, because the targeted frequency f has been set to the frequency at which the value of the inductive reactance $X_L$ becomes a maximum when the closed loop internal conductor (21*g*) is not present in the coil.

Moreover, this inductance device exhibits power for EMI prevention including noise removal, because this inductance device has a resistance component R which is larger than that of the reactance component (inductive reactance $X_L$, capacity reactance $X_c$) due to the reduction of the maximum value of the inductive reactance component $X_L$.

The following example describes the second embodiment.

The inductance device of the second embodiment has the structure shown in FIGS. 1 and 4.

At the inductance device of the second embodiment, the closed loop internal conductor (21*g*) is formed by setting the above-mentioned targeted frequency f to the frequency which causes the value of the inductive reactance component $X_L$ to agree with the value of the resistance component R when the closed loop internal conductor (21*g*) is not present in the coil.

In this inductance device, the inductive reactance component $X_L$ value is reduced, because the targeted frequency f is set to the frequency at which the value of the inductive reactance component $X_L$ agrees with that of the resistance component R when the closed loop internal conductor (21*g*) is not present in the coil.

Moreover, this inductance device exhibits EMI prevention including noise removal, because this inductance device has a resistance component R with a value which is larger than the value of the reactance component (inductive reactance $X_L$, capacity reactance $X_c$) due to the reduction of the maximum value of the inductive reactance $X_L$.

Moreover, this inductance device has a resistance component R with a value which is larger than the value of the reactance component (inductive reactance $X_L$,capacity reactance $X_c$) in a wide frequency band, because the frequency at which the value of the inductive reactance component $X_L$ coincides with that of the resistance component R is lowered.

Accordingly, this inductance device removes noise in a wide frequency range and prevents EMI.

The following example describes the third embodiment.

FIG. 11 shows the structure of an inductance device of the third embodiment.

The inductance device of the third embodiment comprises a coil and closed loop internal conductor (21*g*) which are the same as the above-mentioned sample No. 5 inductance device.

The difference between the third embodiment and sample No. 5 is that the closed loop internal conductor (21*g*) of the third embodiment is placed in the center of the coil.

In the inductance device of the third embodiment, the magnetic sheet (22*g*) is between the magnetic sheet (22*c*) in which the closed loop internal conductor (21*c*) has been formed and the magnetic material sheet (22*d*) in which the closed loop internal conductor (21*d*) has been formed.

In the inductance device of the third embodiment, the closed loop internal conductor (21*g*) is electrically connected by through hole 24 to the internal conductors (21*a*–21*f*) which form the coil.

FIG. 12 illustrates the frequency characteristic of the inductance device of the third embodiment.

In the inductance device of the third embodiment, the frequency at which the value of the resistance component R coincides with the value of the inductive reactance component $X_L$ is 8.2 MHz.

Moreover, since the closed loop internal conductor (21*g*) is in the center of the coil where the magnetic field generated by the coil is the strongest, the effect of the closed loop internal conductor (21*g*) is more conspicuously exhibited, and the frequency band where the resistance component R becomes larger than the reactance component $X_L$ is extended.

The closed loop internal conductor (21*g*) in the center of the coil is electrically connected to the coil in the third embodiment; however a similar effect may be attained if the closed loop internal conductor (21*g*) is isolated from the coil.

The following example describes the fourth embodiment.

FIG. 13 is a diagram of an inductance device of the fourth embodiment. The outward appearance thereof is the same as the one shown in the above-mentioned FIG. 1.

In the fourth embodiment, the inductance device has a two turn closed loop formed by connecting plural internal conductors (21*g*1–21*g*4) instead of the one turn closed loop formed by the closed loop internal conductor (21*g*) in the above-mentioned primary implementation example.

That is, the inductance device of the fourth embodiment is integrally formed by stacking the magnetic sheets (22*a*–22*f*) including internal conductors (21*a*–21*f*), the magnetic sheets (22*g*1–22*g*4) including internal conductors (21*g*1–21*g*4) forming the closed loop, and the magnetic sheets (23) that do not include an internal conductor.

The internal conductors (21*g*1–21*g*4) of the magnetic sheets (22*g*1–22*g*4) are made of a metallic conductor which contains mainly silver. Then, the internal conductors (21*g*1–21*g*4) are electrically connected to each other by through hole (24) to form a spiral shape which surrounds the central axis of the coil formed by the internal conductors (21*a*–21*f*).

Moreover, both edges of the spiral shaped conductor including internal conductors (21*g*1–21*g*4) (that is first end (25*a*) of internal conductor (21*g*1) and second end (25*b*) of internal conductor (21*g*4)) are formed on the end surface in the longitudinal direction of the inductance device body (1) so these edges are exposed. Then, both edges of this spiral shaped conductor are electrically connected to the external electrode (2).

Accordingly, the electrically connected internal conductors (21*g*1–21*g*4) form the two turn closed loop which is connected to the coil.

Also in the inductance device of the fourth embodiment, the frequency in the frequency band in which the inductive reactance $X_L$ occurs is set to the targeted frequency f The ratio (r/L) of series resistance component r to the inductance L is determined from the targeted frequency f and Equation (b) ([$f=\frac{1}{2}\pi(r/L)$]). The closed loop formed by internal conductors (21*g*1–21*g*4) is such that the value of this ratio (r/L) satisfies the expression (c) ([$2\pi f/3.15 \leqq r/L \leqq 2\pi f/0.32$]).

A similar effect can be attained even if a closed loop of more than one turn is formed similar to the inductance device having the above-mentioned structure.

According to the present invention, with the effect of the closed loop internal conductor (21*g* or 21*g*1–21*g*4), the resistance component R can be made larger than the reactance component (inductive reactance $X_L$, capacitive reactance $X_c$) at the specific frequency, and such an inductance device is easily and quickly designed and manufactured without implementing cut and try techniques of the prior art.

Moreover, according to the third embodiment of the present invention, in which the closed loop is in the center of the coil, i.e., where the magnetic field generated by the coil has the most strength, in order to make the closed loop (the internal conductor (21*g* or 21*g*1–21*g*4)) effect larger, the shape and size of the closed loop are not limited by the coil and the degree of freedom in design of the inductance device can be increased.

The above-mentioned first-fourth embodiments are examples of the present invention, which is not limited to these examples. The method of increasing the inductance L value of the closed loop internal conductor can be performed by increasing the number of turns of the closed loop as in the fourth embodiment or by increasing the magnetic permeability of the magnetic sheets forming a closed loop. This is a usual way of increasing the L value.

In the first-fourth embodiments, a multilayer ceramic inductance device is described as an example; however the present invention is not limited to a multilayer ceramic-type inductance device.

The present invention can also be applied to wire-wound inductance devices which are still used widely.

In case of an inductance device wrapped with a conductor around a coil bobbin thereof, the effects of the present invention can be obtained by providing a closed loop in addition to a winding wire which forms a coil, or by forming a closed loop that consciously connects a part of the winding wire of the coil.

What is claimed is:

1. An inductance device designed to have an operating frequency f, comprising in combination:

a coil including a spiral conductive member;

the coil having an inductive reactance at frequency f;

a closed loop conductive member surrounding a central axis of said coil and located adjacent a predetermined portion of said coil;

the closed loop member having a series resistance component having a value, r and an inductance component, L;

first and second connection electrodes connected to first and second ends of said coil, the values of f, r and L being such that $2\pi f/3.15 \leqq r/L \leqq 2\pi f/0.32$.

2. The inductance device as claimed in claim 1, wherein:

said operating frequency f is a frequency causing the inductive reactance to be maximized when said closed loop conductive member is not included in the inductance device.

3. The inductance device as claimed in claim 1, wherein:

said operating frequency f is a frequency causing the value of a resistive component of the coil to equal the value of the inductive reactance when said closed loop conductive member is not included in the inductance device.

4. The inductance device as claimed in claim 1, wherein said closed loop conductive member is electrically connected to the conductive member forming said coil.

5. The inductance device as claimed in claim 1, wherein said closed loop conductive member is in a center portion of said coil.

6. The inductance device as claimed in claim 1, wherein the inductance device is a multilayer type.

7. A method of making an inductance device designed for operation at a frequency f, the inductance device including a coil formed by a spiral conductive member, a closed loop conductive member surrounding a central axis of said coil and located adjacent said coil, the closed loop conductive member having a series resistance component having a value r, and an inductance component having a value L, and first and second connection electrodes respectively connected to first and second ends of said coil, the method comprising selecting the series resistance component, r, and the inductance component, L, of the closed loop conductive members in accordance with $2\pi f/3.15 \leqq r/L \leqq 2\pi f/0.32$, and making the inductance device so the series resistance component, r, and the inductance component, L, of the closed loop conductive members are in accordance with $2\pi f3.15 \leqq r/L \leqq 2\pi f/0.32$.

8. The method of claim 7, wherein:

frequency f is a frequency in which a value of the inductive reactance of the spiral conductive member at frequency f is maximized when said closed loop conductive member is not included in the coil.

9. The method of claim 7, wherein:

frequency f is a frequency at which the value of a resistive component of the coil equals the value of an inductive reactance of the coil at frequency f when said closed loop conductive member is not part of the inductance device.

* * * * *